US005561935A

United States Patent [19]

McCarthy et al.

[11] Patent Number: 5,561,935

[45] Date of Patent: Oct. 8, 1996

[54] TRIGGER LOCK FOR FIREARMS

[75] Inventors: E. Joseph McCarthy; John F. Krueger, both of Wixom; Richard L. Matsu, Plymouth; Sheryar Durrani, Canton, all of Mich.

[73] Assignee: Coastal Trading Company, Wixom, Mich.

[21] Appl. No.: 585,858

[22] Filed: Jan. 16, 1996

[51] Int. Cl.[6] ..... F41A 17/54

[52] U.S. Cl. ..... 42/70.07; 42/70.11

[58] Field of Search ..... 42/70.07, 70.06, 42/70.11

[56] References Cited

U.S. PATENT DOCUMENTS

| | | | |
|---|---|---|---|
| 1,513,267 | 10/1924 | Parks | 42/70.11 |
| 3,616,559 | 11/1971 | Sobolewski | 42/70.07 |
| 3,624,945 | 12/1971 | Foote | 42/70.07 |
| 4,084,341 | 4/1978 | Cervantes | 42/70.11 |
| 4,105,885 | 8/1978 | Orenstein | 42/70.01 |
| 4,122,620 | 10/1978 | Alexander | 42/70.11 |
| 4,154,014 | 5/1979 | Smith | 42/70.06 |
| 4,299,045 | 11/1981 | Cervantes | 42/70.11 |
| 4,354,189 | 10/1982 | Lemelson | 42/70.11 |
| 4,499,681 | 2/1985 | Bako et al. | 42/70.07 |
| 4,509,281 | 4/1985 | Dreiling et al. | 42/70.07 |
| 4,719,713 | 1/1988 | Hagle | 42/70.06 |
| 4,730,407 | 3/1988 | DeCarlo | 42/84 |
| 4,757,629 | 7/1988 | Austin | 42/84 |
| 4,793,085 | 12/1988 | Surawski et al. | 42/84 |
| 4,959,981 | 10/1990 | Davidson | 70/238 |
| 5,012,606 | 5/1991 | McNulty, Jr. | 42/70.11 |
| 5,022,175 | 6/1991 | Oncke et al. | 42/70.11 |
| 5,062,232 | 11/1991 | Eppler | 42/70.11 |
| 5,123,193 | 6/1992 | Pugh | 42/70.11 |
| 5,138,786 | 8/1992 | Fischer | 42/70.11 |
| 5,168,114 | 12/1992 | Enget | 42/70.01 |
| 5,191,158 | 3/1993 | Fuller et al. | 42/70.07 |
| 5,283,971 | 2/1994 | Fuller et al. | 42/70.07 |
| 5,301,448 | 4/1994 | Petrick et al. | 42/70.01 |
| 5,303,495 | 4/1994 | Harthcock | 42/70.11 |
| 5,392,552 | 2/1995 | McCarthy et al. | 42/70.07 |
| 5,417,000 | 5/1995 | Chen | 42/70.06 |
| 5,450,684 | 9/1995 | Harris | 42/70.07 |

*Primary Examiner*—Stephen M. Johnson

*Attorney, Agent, or Firm*—Bliss McGlynn, P.C.

[57] ABSTRACT

A universal firearm locking assembly prevents unauthorized access to a trigger of a firearm. The firearm locking assembly includes a first side member and a second side member which pivot relative to each other about a pivot member. A locking mechanism locks the first side member relative to the second side member after the side members are clamped around the trigger and a trigger guard of the firearm. The locking mechanism includes a spring which is wound around the pivot member with enough force to prevent relative motion between the spring and the pivot member. The spring is secured to one of the side members and the pivot member is secured to the other. An access code input into the circuitry via a keypad will unlock an unlocking plate which can then be rotated to release the spring from the pivot member allowing them and the side members to move relative to each other.

16 Claims, 2 Drawing Sheets

TRIGGER LOCK FOR FIREARMS

BACKGROUND OF THE INVENTION

1. Field of the Invention

The invention relates to trigger locks for firearms. More specifically, the invention relates to electronic locks preventing access to triggers of firearms.

2. Description of the Related Art

As the frequency of violent crimes occurring in residences increases, more and more civilians are purchasing handguns to defend their homes, businesses and other possessions. This action, they feel, is the lesser of two evils wherein the second evil is the potential loss of life or maiming of a child. To reduce the risk of loss of life, gun locks have been employed to prevent the unauthorized use of firearms which at the same time allowing quick access to the firearms by the authorized user.

While such gunlocks presently found in the related art have served an important purpose, disadvantages still remain. The designs of the locking mechanisms incorporated within these gun locks are generally inadequate because most are not universal to all trigger guards for rifles, shotguns and handguns alike. The trigger locks which have been designed to lock more than one (1) type of firearm are difficult to unlock while holding the gun in one hand. This is because the trigger locks which are universal typically include at least two (2) separable parts. Other locks are dangerous if they are used with firearms for which they are not designed. Movement of the trigger lock relative to the firearm may be sufficient to move the trigger and fire the firearm accidentally.

U.S. Pat. No. 5,062,232, issued to Eppler on Nov. 5, 1991, discloses a safety device for firearms wherein an electronic lock is incorporated into the handle of the firearm and prevents the trigger from being pulled. To unlock the firearm, the operator of the firearm must be wearing a glove with a signal generator affixed to the palm of the glove. Although this assembly adequately eliminates the problem of removing a multiple piece gunlock, the operator still needs access to the location where the glove is stored that location being different than the location of the gun for purpose of insuring the safety of the members of the household. This gunlock is gun specific, i.e., the locking assembly only works for one gun. Further, the operator must success fully put the glove on the hand before the safety device will unlock the trigger. Problems may also arise when the operator of the gun is not the owner, yet authorized, but does not shoot the firearm with the same hand. Other problems occur if the gloove is soiled or if the trigger hand is somehow injured. This device cannot work with rifles and shotguns, the majority of the firearms owned in the private sector.

U.S. Pat. No. 5,022,175, issued to Oncke et al. on Jun. 11, 1991, discloses a safety device for a firearm wherein a key pad is located at the base of the handle wherein the correct combination unlocks the trigger allowing an operator to use the firearm. The deficiency associated with this safety lock is that the gunlock is built into the firearm and is not useable with other firearms. It is not universal.

U.S. Pat. No. 4,509,281, issued to Dreiling et al. on Apr. 9, 1985, discloses a gun trigger lock which has two sides which rotate about an axis and cover the trigger and trigger guard of the firearm. A locking member extends through the trigger guard to lock the two sides of the trigger lock around the trigger and trigger guard. This lock does not, however, compensate for trigger guards of various widths. More specifically, the gun trigger lock disclosed in U.S. Pat. No. 4,509,281 closes and locks in a single predetermined position regardless of the width of the trigger guard of the firearm. The fit may have considerable play or it may not fit at all.

SUMMARY OF THE INVENTION

Accordingly, a firearm locking assembly for preventing unauthorized access to a trigger located within a trigger guard of a firearm is disclosed. The firearm locking assembly includes a first side member defining a first longitudinal axis and having a first engaging side to engage the trigger guard. A second side member defines a second longitudinal axis and includes a second engaging side to engage the trigger guard. The second engaging side opposes the first engaging side. A pivot member extends perpendicularly to the first and second longitudinal axes. The first and second side members pivot relative to the pivot member. A locking mechanism locks the second side member in a plurality of positions relative to the first side member.

One advantage associated with the invention includes the ability to lock the trigger of any firearm regardless of the width of the trigger guard. Another advantage of the invention is the ability to unlock and remove the trigger lock with one hand allowing the user to hold the firearm with the other hand. A positive fit of the trigger lock as well as a positive grip on the firearm prevent inadvertent firings of the firearm and increase the safety thereof.

BRIEF DESCRIPTION OF THE DRAWINGS

Other advantages of the present invention will be readily appreciated as the same becomes better understood by reference to the following detailed description when considered in connection with the accompanying drawings, wherein.

DESCRIPTION OF THE PREFERRED EMBODIMENT(S)

Figure 1:
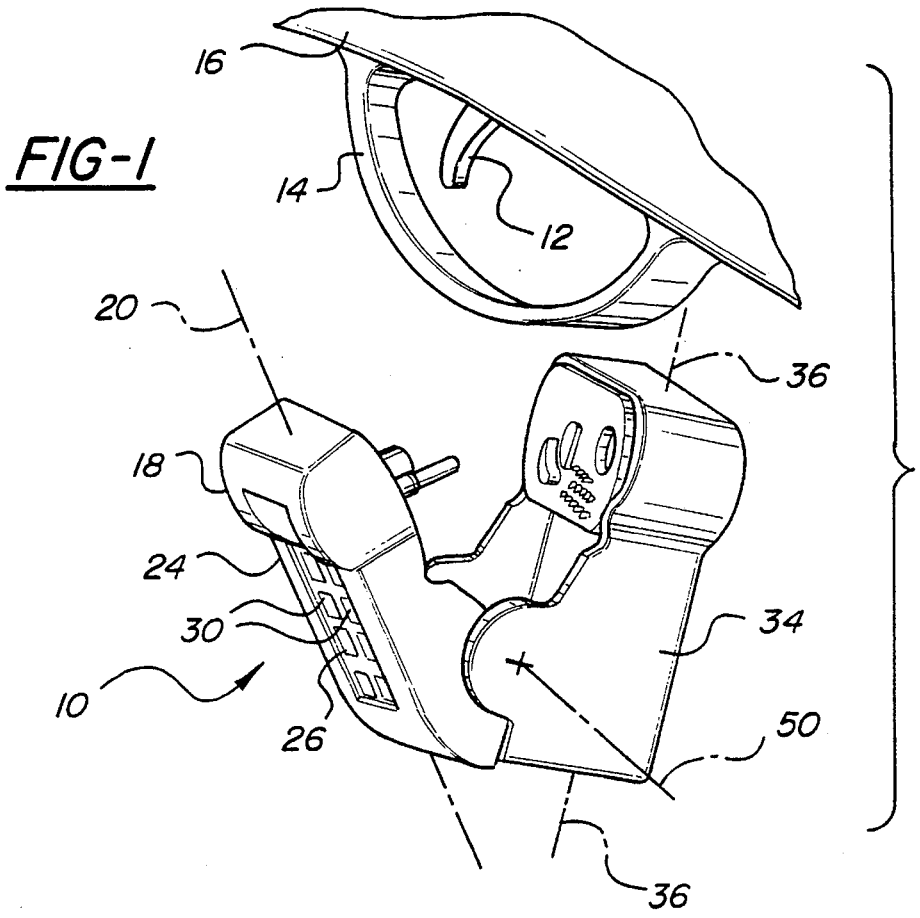
FIG. 1 is a perspective view of one embodiment of the invention adjacent a trigger guard of a firearm.
Figure 2:
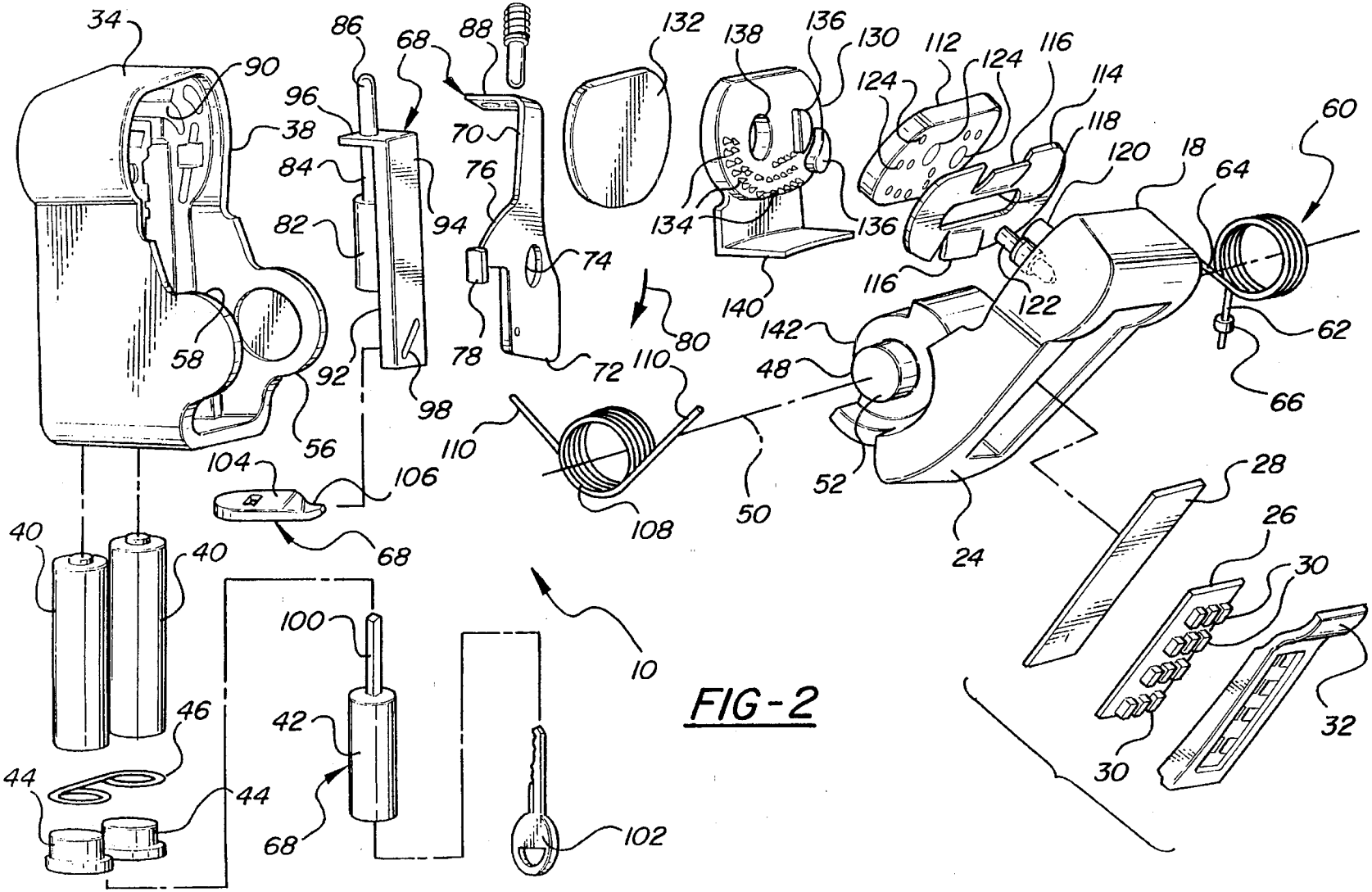
FIG. 2 is an exploded view of the embodiment shown in FIG. 1.

Referring to FIGS. 1 and 2, the invention, a firearm locking assembly, is generally indicated at 10. The firearm locking assembly 10 prevents unauthorized access to a trigger 12 located within a trigger guard 14 of a firearm 16 (partially shown in FIG. 1).

The firearm locking assembly 10 includes a first side member 18. The first side member 18 defines a first longitudinal axis 20 and includes a first engaging side 22. The first engaging side 22 engages the trigger guard 14. The first side member 18 further includes a first non-engaging side 24 opposite the first engaging side 22. The first non-engaging side 24 houses a electronic key pad 26 and circuit board 28. The key pad 26 includes a plurality of keys 30 which allows the user to input an unlocking code to unlock the firearm locking assembly 10. A cover 32 houses the circuits 28 and the electronic key pad 26. The electronics associated with the code and the input thereof will be discussed in greater detail subsequently.

The firearm locking assembly 10 further includes a second side member 34. The second side member 34 defines a second longitudinal axis 36 and includes a second engaging side 38. The second engaging side 38 opposes the first engaging side 22 of the first side member 18. The second engaging side 38 also engages the trigger guard 14. The second side member 34 houses a battery 40, as shown in FIG. 2, and a key cylinder 42. Two caps 44 and a clip 46 hold the batteries 40 inside the second side member 34. Although not shown, it may be appreciated by those skilled in the art that the electrical leads extend between the batteries 40 and the electronic circuit 28.

A pivot member 48 defines a longitudinal axis 50. The pivot member 48 and the pivot longitudinal axis 50 extend perpendicularly to the first 20 and second 36 longitudinal axes. The first side member 18 and the second side member 34 pivot about the pivot member 48 relative to each other. In the embodiment shown in FIGS. 1 and 2, the pivot member 48 is housed and secured to a first side member 18. It may be appreciated by those skilled in the art that the pivot member 48 may, in other embodiments, be secured to the second side member 34 or to neither side members 18, 34. The pivot member 48 includes a first half 52 and a second half (not shown). As may be seen by viewing a receiving hole 54 in the second side member 34, the first half 52 of the pivot member 48 and the second half (not shown) have differing diameters. More specifically, the second half of the pivot member 48 is larger than the first half 52 of the pivot member 48. The second half has a larger circular cross section, diameter and periphery than that of the first half 52 for reasons set forth below. The pivot member 48 is received in the receiving hole 54 and a second hole (not shown). Two side extensions 56, 58 extend out and away from the second side member 34 and house the receiving holes 54.

Figure 3:
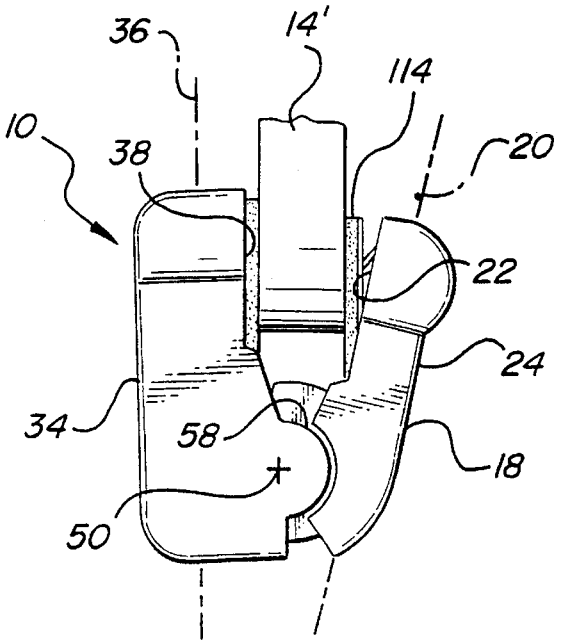
FIG. 3 is a front view of one embodiment of the invention locked onto a trigger guard of a firearm.
Figure 4:
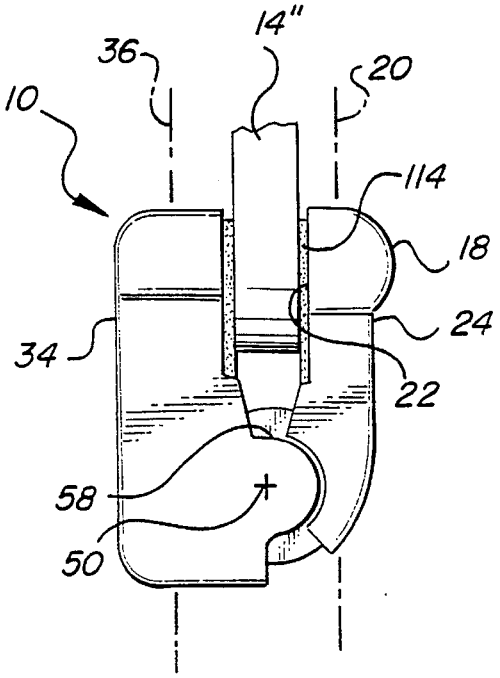
FIG. 4 is a front view of one embodiment of the invention locked onto a second trigger guard of a second firearm.

The firearm locking assembly 10 also includes a locking mechanism, generally indicated at 60 in FIG. 2. The locking mechanism 60 locks the second side member 34 in a plurality of positions relative to the first side member 18. It may be seen that the second side member 34 is locked in two (2) positions about two (2) triggers guards, 14' and 14" in FIGS. 3 and 4, respectively. The locking mechanism 60 allows the firearm locking assembly 10 to be used as a universal trigger lock such that it may be used on any firearm 16 having a trigger guard 14. More specifically, the width of the trigger guard 14, 14', 14" is not a relevant factor as to the functionality of the firearm locking assembly 10. The firearm locking assembly 10 will work on triggers guards 14, 14', 14" of any width.

The locking mechanism 60 locks the first side member 18 and the second side member 34 about the trigger guard 14. The locking mechanism 60 is disposed outside of the trigger guard 14 when the first 18 and second 34 side members are secured about and disposed adjacent to the trigger guard 14. As may be seen in FIGS. 1, 3 an 4, the locking mechanism 60 is located below the trigger guard 14. In this embodiment, the locking mechanism 60 is a spring wound around a portion of the pivot member 48. The spring 60 has a first end 62 and a second end 64. The first end 62 is captured, using a washer 66, by the second side member 34. The second end 64 is free to move with respect to the first side member 18 and the second side member The spring 60 is wound around the pivot member 48 such that there is no relative movement therebetween. More specifically, the spring 60 provides frictional damping and cannot move relative to the pivot member 48. In one embodiment, the spring 60 is fabricated from a wound piece of metal having a rectangular cross-section. Only when the second end 64 is moved in a unwinding manner is relative motion between the spring 60 and the pivot member 48 allowed. The releasing of the spring 60 by moving the second end 64 allows the first side member 18 and the second side member 34 to move relative to each other. When the second end 64 is allowed to return to its locking position, the first 18 and second 34 side members are locked in their relative positions regardless of what their respective positions are. The locking mechanism 60 is universal in this manner.

Referring to FIG. 2, the firearm locking assembly 10 includes an unlocking assembly, generally shown at 68. The unlocking assembly releases force exerted on the pivot member 48 by the spring 60. The unlocking mechanism 68 includes an unlocking plate 70 which is pivotally engagable with the second end 64 of the spring 60. The unlocking plate 70 includes an engagement end 72 which forces the second end 64 down increasing the average diameter of each coil of the spring 60 resulting in the pivot member 48 and the first side member 18 being free to move relative to the spring 60 and the second side member 34. The unlocking plate 70 pivots about a pivot hole 74 (the structure, i.e., a pin, about which the unlocking plate 70 pivots is not shown).

The unlocking plate 70 further includes an unlocking arm 76 having a force receiving pad 78 secured to the distal end thereof. By using a finger or a thumb, the user can apply a force to the force receiving pad 78 to force the unlocking plate 70 in a clockwise direction as shown by arrow 80.

Because the force receiving pad 78 and the unlocking arm 76 extend out beyond the first side member 18 and the second side member 34, the unlocking plate 70 must be locked preventing any rotational motion until authorized access is provided. The principal method of obtaining authorized access is to input a code into the electronic key pad 26. An authorized code will activate a solenoid 82 which will force a plunger 84 down into the solenoid 82. A disclosure detailing one embodiment of the electronic circuitry used to operate the electronic keypad 26 is U.S. Pat. No. 5,392,552 which is hereby incorporated by reference. The solenoid 82 receives its power from the batteries 40 and operates similar to solenoids well known in the art. A distal end 86 of the plunger 84 extends up into a plunger receiving surface 88 of the unlocking plate 70 when the solenoid 82 is not activated. More specifically, the plunger 84 extends up out of the solenoid coil 82 when no current is passing therethrough. The plunger 84 is springed bias (the spring is not shown) up out of the solenoid 82. The plunger receiving surface 88 includes a first hole 89 for receiving the distal end 86 of the plunger 84 therein. When the solenoid 82 is activated, the plunger 84 retreats into the solenoid 82 wherein the distal end 86 of the plunger 84 disengages the plunger receiving surface 88 allowing the unlocking plate 70 to rotate clockwise to unlock the firearm locking assembly 10. If a proper access code has been entered via the electronic key pad 26, the solenoid 82 will retract the plunger 84 for a predetermined time, i.e., five (5) seconds, allowing the user enough time to rotate the unlocking plate by engaging the force receiving pad 78. A groove 90 in the second side member 34 limits the rotational movement allowed by the unlocking plate 70 as the plunger receiving surface extends into the groove 90.

In one embodiment shown in FIG. 2, the plunger receiving surface 88 also includes a second hole 91 for receiving a motion pin 93 therein. A motion spring 95 spring biases the motion pin 93 up and out of the second hole 91. The motion spring 95 is, however, overcome by acceleration forces when the firearm locking assembly 10 is rapidly moved (downwardly as shown in the Figures). When the acceleration force exceeds the force of the motion spring 95, the motion pin 93 moves down into the second hole 91 preventing the unlocking plate 70 from being rotated. Therefore, an acceleration force great enough to overcome the forces acting on the solenoid plunger 86 to force it out of the first hole 89 will not release the unlocking plate 70 because the motion pin 93 will be forced into the second hole 91 at the same time.

The solenoid 82 is attached to the second side member 34 via a mounting bracket 92. The mounting bracket 92 has a longitudinal body 94 with a plunger guiding surface 96 extending out from the longitudinal body 94 substantially perpendicular therewith. The solenoid 82 is fixedly secured to the mounting bracket 92 such that there is no relative motion therebetween. The plunger 84 moves relative to the mounting bracket 92. The plunger guiding surface 96 does not impede the movement of the plunger 84 as it moves up and down and into and out of the solenoid 82. The mounting bracket 92 is fabricated from a high gloss acetal which is a self-lubricating material.

The mounting bracket 92 includes a cam receiving surface 98 extending through at least a portion of the longitudinal body 94. The cam receiving surface 98 extends along an axis which is not parallel to the longitudinal axis of the longitudinal body 94.

The unlocking mechanism 68 includes a second independent fully mechanical unlocking system which operates independently of the portion of the unlocking mechanism 68 which is electronically driven. More specifically, the unlocking mechanism 68 includes the key cylinder 42 which has a key shaft 100 extending out therefrom. The key shaft 100 may have any cross-section suitable for its function. In the embodiment shown in FIG. 2, the key shaft 100 has rectangular cross-section. A key 102 is removably insertable into the key cylinder 42 to rotate the key shaft 100. A cam 104 is secured to the key shaft 100 and rotates with the key shaft 100. The cam includes a cam point 106 which extends into the cam receiving surface 98 of the mounting bracket 92. By rotating the cam 104 using the key 102, the cam point 106 travels through the cam receiving surface 98. Because the cam receiving surface 98 is at an angle other than parallel or perpendicular to the longitudinal axis of the longitudinal body 94, the mounting bracket 92 moves along its longitudinal axis. More specifically, the rotation of the cam 104 translates into axial motion of the mounting bracket 92 in an up and down motion along its longitudinal axis. Because the solenoid 82 is fixably secured to the mounting bracket 92, movement of the mounting bracket translates into movement of the solenoid 82. Therefore, movement of the solenoid 82 downwardly (with respect to the orientation shown in FIG. 2) results in a downward motion of the solenoid 82 which, in turn, axially moves the plunger 84 downwardly. The downward movement of the plunger 84 due to the movement of the whole solenoid 82 is similar to the downward motion of the plunger 84 when the solenoid 82 is activated, resulting in non-engagement with the plunger receiving surface 88 allowing the unlocking plate 70 to rotate to unlock the firearm locking assembly 10.

When the unlocking plate 70 has rotated forcing the locking spring 60 to unlock the pivot member 48, a release spring 108 having arms 110 abutting the first side member 18 and second member 34 forces the first side member 18 and second side member 34 to pivot away from each other about the pivot member 48. The release spring 108 is coaxial with the pivot member 48.

A first rubber pad 112 is an intermediate interface and disposed adjacent the first side member 18. The first rubber pad 112 is supported by a first support plate 114. The first support plate 114 is springed biased by two leaf springs 116. The two leaf springs 116 are cut out of the first support plate 114. Because the first support plate 114 is spring biased, the spring 60 may be replaced by a rachet system with a pawl locking the side members 18, 34 in place. Although this embodiment would not provide an infinite number of locking positions, a plurality of locking positions would be available for trigger guards of varying widths. This rachet system is not shown in the Figures.

An elongated opening 118 extends through a portion of the first support plate 114 to allow a locking lug 120 and a removable pin 122 to extend therethrough. The first rubber pad 112 also includes a plurality of holes 124 to allow the locking lug 120 and the removably pin 122 to extend therethrough and abut the trigger guard 14 of the firearm 16. The removable pin 122 is removably secured to the first side member 18 at random positions, chosen by the user of the firearm locking assembly 10 to minimize the relative motion of the firearm locking assembly 10 with the trigger 12. A plurality of removable pins 122 may be used even though only one is shown in the Figures. The removable 122 includes a collar 126 and threads 128 to engage the first side member 18. It may be appreciated by those skilled in the art that other configurations of the removable pins 122 are possible.

A second rubber pad 130 is supported by a second support plate 132 which is secured to the second side member 34 over the unlocking plate 70. The second rubber pad 130 includes a plurality of rubber cones 134 and spacers 136 to help insure the proper orientation of the firearm locking assembly 10 about the trigger 12 and to minimize the movement of the firearm locking assembly 10 with respect to the trigger 12. A hole 138 extends through the second rubber pad 130 to allow the locking lug 120 to pass therethrough if the trigger guard 14 is narrow. An L-shaped cover 140 extends down from the second rubber plate 130. The cover 140 covers any wires (not shown) which extend from the batteries 40 to the electronic circuit 28 as well as the housing 142 which houses the pivot member 48.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

We claim:

1. A firearm locking assembly for preventing unauthorized access to a trigger located within a trigger guard of a firearm, said firearm locking assembly comprising:

a first side member defining a first longitudinal axis and having a first engaging side to engage the trigger guard;

a second side member defining a second longitudinal axis and having a second engaging side to engage the trigger guard, said second engaging side opposing said first engaging side;

a pivot member extending perpendicularly to said first and second longitudinal axes, said first and second side members pivoting relative to said pivot member;

a locking mechanism locking said second side member in a plurality of positions relative to said first side member, said locking mechanism including a locking spring having a first end and a second end, said first end being secured to said second side member; and an unlocking mechanism having an unlocking plate pivotally engagable with said second end.

2. A firearm locking assembly as set forth in claim 1 wherein said unlocking plate includes an arm extending out beyond said first and second side members to receive a pivoting force to pivot said unlocking plate.

3. A firearm locking assembly as set forth in claim 2 including a release spring applying a releasing force against each of said first and second side members to force said first and second side members to pivot away from each other.

4. A firearm said locking assembly as set forth in claim 1 including an intermediate interface extending out from at least one of said first and second side members to maximize engagement of said first and second side members with the trigger guard.

5. A firearm locking assembly as set forth in claim 4 wherein said intermediate interface is springed biased out toward the trigger guard.

6. A firearm locking assembly as set forth in claim 1 including a motion pin engagable with said unlocking plate.

7. A firearm locking assembly as set forth in claim 6 wherein said motion pin includes a motion spring for spring biasing said motion pin out and away from said unlocking plate.

8. A firearm locking assembly as set forth in claim 1 wherein said unlocking mechanism includes a solenoid having a plunger for engaging said unlocking plate to prevent the pivoting thereof.

9. A firearm locking assembly as set forth in claim 8 wherein said unlocking mechanism includes a mounting bracket to mount said solenoid to said firearm locking assembly.

10. A firearm locking assembly as set forth in claim 9 wherein said mounting bracket includes a cam receiving surface.

11. A firearm locking assembly as set forth in claim 10 wherein said unlocking mechanism includes a mechanical unlocking device to move said plunger out of engagement with said unlocking plate.

12. A firearm locking assembly as set forth in claim 11 wherein said mechanical unlocking device includes a key and key cylinder wherein said key is removable from said firearm locking assembly.

13. A firearm locking assembly as set forth in claim 12 wherein said mechanical unlocking device further includes a cam fixedly secured to said key cylinder and engagable with said cam receiving surface wherein said cam moves said mounting bracket axially when said cam is rotated by said key and said key cylinder.

14. A firearm locking assembly as set forth in claim 8 further including a code entry device for entering a code to activate said plunger of said solenoid to release said unlocking plate.

15. A firearm locking assembly as set forth in claim 14 including circuitry to receive a coded input by said code entry device.

16. A firearm locking assembly for preventing unauthorized access to a trigger located within a trigger guard of a firearm, said firearm locking assembly comprising:

a first side member defining a first longitudinal axis and having a first engaging side to engage the trigger guard;

a second side member defining a second longitudinal axis and having a second engaging side to engage the trigger guard, said second engaging side opposing said first engaging side;

a pivot member extending perpendicularly to said first and second longitudinally axes, said first and second side members pivoting relative to said pivot members;

a locking mechanism locking said second side member in a plurality of positions relative to said first side member; and an unlocking mechanism for unlocking the locking mechanism, said unlocking mechanism including an unlocking plate movable between unlocking and locking positions and a release to release said unlocking plate allowing said unlocking plate to move between said unlocking and locking positions.

* * * * *